US010319155B2

(12) United States Patent
Vemulapalli

(10) Patent No.: US 10,319,155 B2
(45) Date of Patent: Jun. 11, 2019

(54) SYSTEM FOR TRACKING PARTICIPANTS

(71) Applicant: Ravi Vemulapalli, Clive, IA (US)

(72) Inventor: Ravi Vemulapalli, Clive, IA (US)

( * ) Notice: Subject to any disclaimer, the term of this patent is extended or adjusted under 35 U.S.C. 154(b) by 747 days.

(21) Appl. No.: 13/746,734

(22) Filed: Jan. 22, 2013

(65) Prior Publication Data

US 2014/0204213 A1 Jul. 24, 2014

(51) Int. Cl.
*A63B 71/06* (2006.01)
*G07C 1/22* (2006.01)

(52) U.S. Cl.
CPC ..... *G07C 1/22* (2013.01); *A63B 71/06* (2013.01)

(58) Field of Classification Search
CPC ..... A63B 71/06; G07C 1/24; G07C 1/22
See application file for complete search history.

(56) References Cited

U.S. PATENT DOCUMENTS 8,437,242 B2 * 5/2013 Umezawa ..... G11B 7/24038 369/116
8,473,242 B1 * 6/2013 Hubbard ..... A61B 5/1112 702/150
9,607,443 B2 * 3/2017 Harvey ..... G07C 1/24
2004/0064838 A1 * 4/2004 Olesen ..... H04N 7/181 725/105
2011/0250939 A1 * 10/2011 Hobler ..... A63F 13/812 463/7
2013/0231760 A1 * 9/2013 Rosen ..... G06F 17/40 700/91
2013/0342699 A1 * 12/2013 Hansen ..... G07C 1/24 348/157
2014/0013361 A1 * 1/2014 Monari ..... H04N 5/2252 725/62

* cited by examiner

*Primary Examiner* — Jefferey F Harold
*Assistant Examiner* — Justin B Sanders
(74) *Attorney, Agent, or Firm* — Zarley Law Firm, P.L.C.

(57) ABSTRACT

A tracking system having a website connected to a electronic device over an electronic network. Identification information associated with participant information related to an identification chip worn by a participant and stored in the electronic device. The website displays the present position of a selected participant, a live continuous video feed from selected check points, the pace of the selected participant and the estimated time of arrival for the participant at a selected check point.

12 Claims, 1 Drawing Sheet

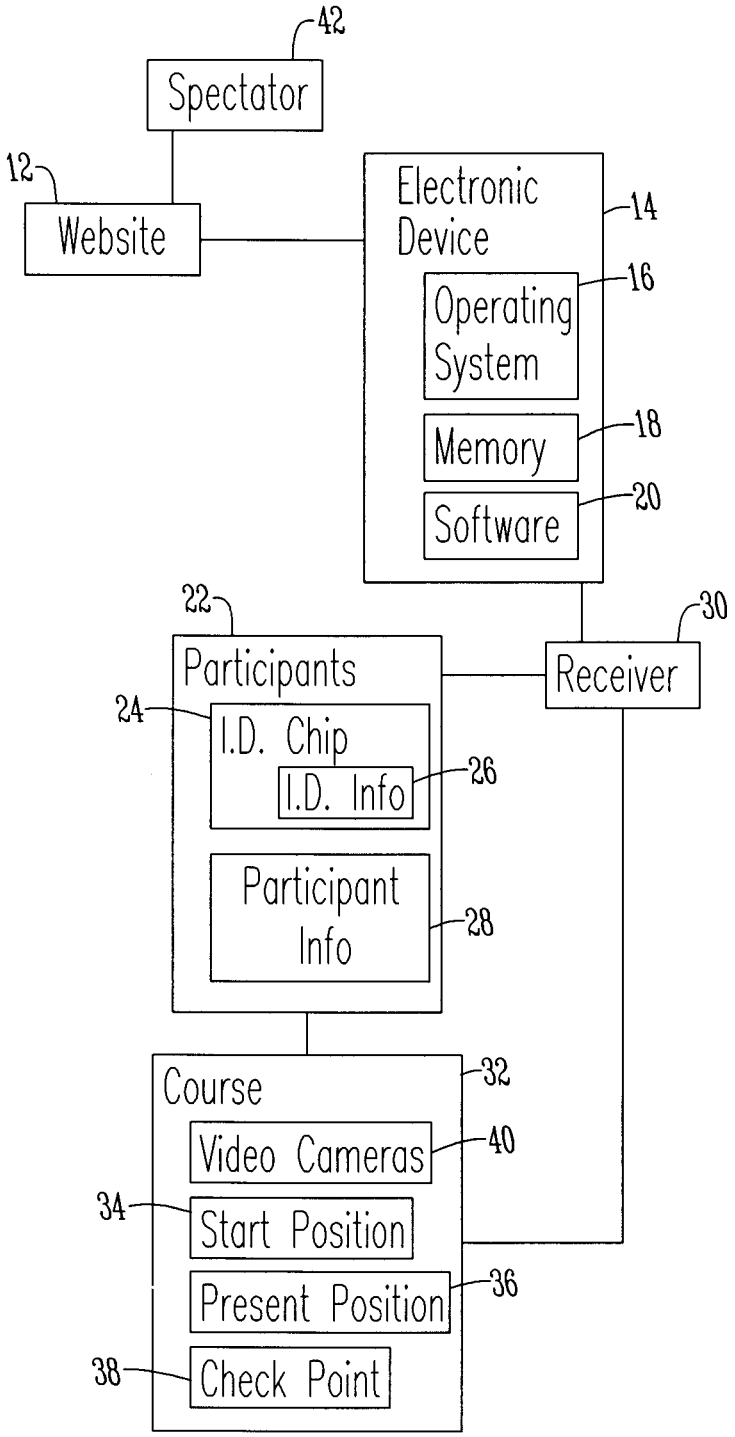
42
Spectator
12
Website
Electronic Device
14
Operating System
16
Memory
18
Software
20
22
Participants
30
Receiver
24
I.D. Chip
I.D. Info
26
Participant Info
28
Course
32
Video Cameras
40
34
Start Position
Present Position
36
38
Check Point

SYSTEM FOR TRACKING PARTICIPANTS

BACKGROUND OF THE INVENTION

This invention is directed toward a system for tracking participants in an event and more particularly toward a tracking system that enhances an event for spectators.

Tracking participants in an event is known in the art. For example, for longer road races such as marathons, participants are provided a chip that transmits a signal when crossing devices at designated locations on the race course. The transmitted information is then sent to spectators to inform them of the participant's progress.

While helpful, these systems have several deficiencies. For example, the systems do not provide information of the participant in between check points, nor an estimated time of arrival at a check point. Thus, spectators have difficulty navigating the race course in order to observe a specific participant. Further, no video is provided at the check points to permit a spectator to observe a selected participant from a remote location.

Thus, an objective of the system is to provide a tracking system that estimates a time of arrival of a participant at a check point.

Another objective is to provide a tracking system that permits a spectator to observe a participant from a remote location.

These and other objectives will be apparent to one of ordinary skill in the art based upon the following written description, drawings, and claims.

SUMMARY OF THE INVENTION

A tracking system having a website connected to an electronic device over an electronic network. Identification information associated with participant information related to an identification chip worn by a participant and stored in the electronic device. The website displays the present position of a selected participant, a live continuous video feed from selected check points, the pace of the selected participant and the estimated time of arrival for the participant at a selected check point.

BRIEF DESCRIPTION OF THE FIGURE

The FIGURE shows a schematic view of a tracking system.

DETAILED DESCRIPTION OF THE PREFERRED EMBODIMENTS

Referring to the FIGURE, a participant tracking system 10 includes a website 12 connected to an electronic device 14 and connected to an electronic network. The electronic device 14 has an operating system 16, memory 18, and software 20.

A plurality of participants 22, such as runners in a marathon, are issued an identification card, chip, or transmitter 24 that includes identification information 26. At the time of providing the chip 24, participant information 28 associated with the identification information 26 is entered into the electronic device 14 and stored in the memory 18. Each participant 22 attaches the chip 24 to their body or clothing and a signal is sent to a receiver 30 that provides the geographic location of the participant 22. The receiver is connected to the electronic device 14.

Utilizing the software 20 and the operating system 16, the electronic device 14 determines the geographic location of the participant based upon the transmitted information. The location of the participant is then shown on the website 12 in relation to the course 32 stored in the memory 18 and is updated in real time. The electronic device 14 also calculates the participant's pace based upon the distance and elapsed time between the start position 34 and start time and the participant's present position 36. The participant's 22 pace is displayed on the website and the pace for preselected intervals may also be displayed.

In addition, the electronic device calculates an estimated time of arrival at a selected check point 38. The ETA is based upon the participant's average pace over a selected time interval and the distance between the participant's present position 36 and the selected check point. The ETA information is displayed on the website 12. The electronic device, based on personal information and geographic location, can calculate the participant's place in the race and place in subcategories such as sex and/or age. This information is periodically saved by the electronic device 14 for later review.

Video cameras 40 are positioned at selected check points 38 on the course 32. The video cameras 40 transmit a live feed that is received and displayed on the website 12 by the electronic device 14.

In operation, a spectator 42 accesses the website 12 via the electronic network. The spectator either enters participant 28 and/or identification information or searches for the participant 22 from a listing 44 displayed on the website 12. Once the participant is selected, the electronic device 14 displays the participant's 22 position 36 as compared to the course 32, and calculates and displays the participant's pace and ETA to selected check points 38. As a result, the spectator can move about the course 32 in order to view the participant. Alternatively, the spectator 42, if in a remote location, will know the ETA in order to view the participant 22 as they pass a check point 38 via the video display.

What is claimed is:

1. A tracking system, comprises:

a website connected over an electronic network to an electronic device having an operating system, memory, and software;

a plurality of participants having an identification chip with identification information and associated participant information that is entered into and stored in the electronic device through the electronic network;

a listing of the plurality of participants displayed on the website, wherein the listing is searchable;

wherein the website displays the position of a selected participant on a course which is updated in real time when a spectator selects the selected participant, the website displays the selected participant's estimated time of arrival to a check point.

2. The system of claim 1 wherein the website displays the selected participants as calculated by the electronic device.

3. The system of claim 1 wherein the website displays an estimated time of arrival at a selected check point as calculated by the electronic device.

4. The system of claim 1 wherein at least one video camera is positioned at a selected check point and provides a live continuous feed that is displayed on the website.

5. The system of claim 1 wherein the selected participant's pace is calculated by the electronic device.

6. The system of claim 5 wherein the selected participant's pace is calculated based upon the distance and time between a start point and the selected participant's present position.

7. The system of claim 5 wherein the selected pace is displayed on the website.

8. The system of claim 5 wherein the selected participant's pace for preselected intervals is displayed on the website.

9. The system of claim 1 wherein the website displays a present position of a participant selected from the listing by a spectator.

10. The system of claim 1 wherein when the spectator selects the selected participant, the website displays the selected participant's current position on the course and current pace.

11. The system of claim 1 further comprising the course having video cameras positioned at a plurality of checkpoints, wherein the video cameras transmit a live feed that is displayed on the website.

12. The system of claim 1 wherein when a spectator selects a selected checkpoint, the website displays the selected live feed from the video camera positioned at the selected checkpoint.

* * * * *